US010834511B2

(12) United States Patent
Kvist

(10) Patent No.: US 10,834,511 B2
(45) Date of Patent: Nov. 10, 2020

(54) HEARING AID WITH AN ANTENNA

(71) Applicant: GN Hearing A/S, Ballerup (DK)

(72) Inventor: Søren Kvist, Vaerlose (DK)

(73) Assignee: GN Hearing A/S, Ballerup (DK)

( * ) Notice: Subject to any disclaimer, the term of this patent is extended or adjusted under 35 U.S.C. 154(b) by 0 days.

(21) Appl. No.: 16/101,297

(22) Filed: Aug. 10, 2018

(65) Prior Publication Data

US 2019/0069101 A1 Feb. 28, 2019

(30) Foreign Application Priority Data

Aug. 30, 2017 (EP) ..... 17188504

(51) Int. Cl.
*H04R 25/00* (2006.01)
*H01Q 5/371* (2015.01)
*H01Q 1/27* (2006.01)

(52) U.S. Cl.
CPC ..... *H04R 25/554* (2013.01); *H01Q 1/273* (2013.01); *H01Q 5/371* (2015.01); *H04R 2225/023* (2013.01); *H04R 2225/025* (2013.01); *H04R 2225/51* (2013.01)

(58) Field of Classification Search
CPC ..... H04R 25/554; H04R 2225/023; H04R 2225/025; H04R 2225/51; H01Q 5/371; H01Q 1/273
USPC ..... 381/315
See application file for complete search history.

(56) References Cited

U.S. PATENT DOCUMENTS

2013/0342407 A1* 12/2013 Kvist ..... H01Q 1/273 343/718
2013/0343586 A1* 12/2013 Kvist ..... H04R 25/554 381/315
2014/0010392 A1 1/2014 Kvist
2015/0036854 A1 2/2015 Polinske et al.

FOREIGN PATENT DOCUMENTS

EP 2 871 861 A1 5/2015
EP 2 986 030 A1 2/2016

OTHER PUBLICATIONS

Extended European Search Report dated Jan. 1, 2018 for corresponding European Patent Application No. 17188504.9.

* cited by examiner

*Primary Examiner* — Sean H Nguyen
(74) *Attorney, Agent, or Firm* — Vista IP Law Group, LLP

(57) ABSTRACT

A hearing aid has an assembly comprising an antenna. The antenna comprises a differential transmission line carrying a first and a second antenna feed signals and leading to a first and a second antenna feed points, the first and the second antenna feed signals being out of phase. The antenna further comprises a first antenna branch extending from the first antenna feed point and having a first distal end and a second antenna branch extending from the second antenna feed point and having a second distal end. The first antenna branch and the second antenna branch each has an electrical length anywhere from 3λ/8 to 5λ/8. The antenna also has a third antenna branch that connects the first and the second antenna branches. Ratio of the electrical length of the third antenna branch to that of the first or the second antenna branch is at least 0.1.

44 Claims, 5 Drawing Sheets

HEARING AID WITH AN ANTENNA

RELATED APPLICATION DATA

This application claims priority to, and the benefit of, European Patent Application No. 17188504.9 filed on Aug. 30, 2017, pending. The entire disclosure of the above application is expressly incorporated by reference herein.

FIELD

The present disclosure relates to a hearing aid having an antenna that provides the hearing aid with wireless communication capabilities.

BACKGROUND

Hearing aids are very delicate devices and comprise many mechanic and electronic components. This presents considerable challenges for hearing aid developers. Developing miniature hearing aids that are completely wearable in the ear, e.g. in-the-ear hearing aid (ITE) or completely-in-the-canal hearing aid (CIC), presents even greater challenges. Further and as the industry evolves, the hearing aids are continuously being provided with increased functionality. For instance, for user's having a hearing aid in each ear, it is beneficial if the two hearing aids are able to wirelessly communicate with each other. Considering all of the above, integration of a suitable antenna into a hearing aid clearly imposes extremely high design constraints. This is particularly true for the hearing aids that are completely wearable in the ear.

SUMMARY

It is an object of the present disclosure to provide a hearing aid having an improved wireless communication capability in accordance with the main claim, and by the embodiments according to the dependent claims.

More specifically, the present disclosure provides a hearing aid for placement in the ear, such as In-The-Canal (ITC) or In-The-Ear (ITE) hearing aid, with an assembly, the assembly comprising a microphone for reception of sound and conversion of the received sound into a corresponding first audio signal, a signal processor for processing the first audio signal into a second audio signal compensating a hearing loss of a user of the hearing aid, and a wireless communication unit configured for wireless communication, connected with an antenna configured for electromagnetic field emission and/or electromagnetic field reception at a wavelength lambda ($\lambda$). The antenna comprises a differential transmission line carrying a first and a second antenna feed signals and leading to a first and a second antenna feed point, wherein the first and the second antenna feed signals are out of phase. A first antenna branch extends away from the first antenna feed point and has a first distal end, a second antenna branch extends away from the second antenna feed point and has a second distal end, wherein the first antenna branch and the second antenna branch have the same electrical length, the electrical length of the first and the second branch being in the range $3\lambda/8$ to $5\lambda/8$. A third antenna branch extends between the first distal end and the second distal end so as to connect the first and the second branch, wherein ratio of the electrical length of the third antenna branch to the first or the second antenna branch is at least 0.1.

Throughout the application, the term electrical length is to be construed as the amount of degrees or radians of phase-shift that a signal undergoes when it travels along a transmission line or antenna branch. The electrical length is linearly proportional to the wavelength, such that 1 wavelength is 360 degrees (or $2\pi$ radians) of phase shift, and 0.5 wavelength is 180 degrees (or $\pi$ radians).

Further, the term "distal" has its ordinary meaning, i.e. it denotes a point situated away from the antenna feed point.

In the following, positive effects and advantages are presented.

The solution at hand affords a hearing aid with an improved performance. Firstly, the antenna feed signals reaching a first and a second antenna feed points are carried by means of a differential transmission line. Advantageously, the entire antenna structure thus becomes less dependent on the ground plane so that the properties of the antenna may more easily be adjusted.

Further, the fact that the first and the second antenna branches have the same electrical length renders the antenna structure electrically symmetrical. This is necessary to balance the currents in the first and the second antenna branches. More specifically, when the antenna of the hearing aid is in use, a current in the first antenna branch flows in a first direction whereas a current in the second antenna branch flows in a second direction. A current in the first branch and a current in the second branch typically have the same magnitude but run in opposite directions, whereby the radiation of the electromagnetic field, as generated by these currents, in this direction is kept at a minimum. Said direction is substantially parallel to the lateral surface of the head of the user, when the hearing aid is worn in its operational position. This is only possible if the two antenna branches are positioned sufficiently close with respect to each other. With respect to the third antenna branch, ratio of the electrical length of the third antenna branch to any one of the first or the second antenna branches is at least 0.1. This entails that sufficient radiation efficiency of the antenna structure may be obtained without creating a prohibitively large antenna structure.

By virtue of the claimed antenna configuration and in particular the electrical lengths of the first and the second branch, respectively, the current distribution in the third antenna branch reaches a maximum. In consequence, the dipole moment radiated by the third antenna branch is maximized. Here, the third antenna branch is normally oriented substantially perpendicular to the lateral surface of the head of the user, when the hearing aid is worn in its operational position. In consequence, the maximized current flowing in the third antenna branch contributes to a strong electromagnetic field that travels around the head of the user, passing also by the top of the head. In other words, efficient wireless communication between the two hearing aids worn in the ear is enabled. A robust and powerful antenna solution for the hearing aid is hereby provided that in addition experiences low losses.

A hearing aid includes an assembly, the assembly comprising: a microphone configured to receive sound and to provide a first audio signal based on the received sound; a signal processor configured to provide a second audio signal based on the first audio signal for compensating a hearing loss of a user of the hearing aid; an antenna configured for electromagnetic field emission and/or electromagnetic field reception at a wavelength $\lambda$; and a wireless communication unit configured for wireless communication, the wireless communication connected with the antenna; wherein the antenna comprises: a differential transmission line configured to carry a first antenna feed signal and a second antenna feed signal to a first antenna feed point and a second antenna feed point, wherein the first antenna feed signal and the second antenna feed signal are out of phase; a first antenna branch extending from the first antenna feed point and having a first distal end, wherein an electrical length of the first antenna branch is anywhere from 3λ/8 to 5λ/8; a second antenna branch extending from the second antenna feed point and having a second distal end, wherein an electrical length of the second antenna branch is anywhere from 3λ/8 to 5λ/8; and a third antenna branch connecting the first antenna and the second antenna branch, wherein a ratio of an electrical length of the third antenna branch to the electrical length of the first antenna branch or to the electrical length of the second antenna branch is at least 0.1.

Optionally, at least a first section of the first antenna branch is parallel to at least a first section of the second antenna branch.

Optionally, the third antenna branch is perpendicular to at least one of the first and the second antenna branches.

Optionally, the first distal end is located opposite with respect to the second distal end.

Optionally, the hearing aid further includes a face plate, wherein at least a section of the first antenna branch and/or at least a section of the second antenna branch is positioned adjacent the face plate.

Optionally, the third antenna branch is perpendicular to a plane of the face plate.

Optionally, the first antenna branch comprises first bend(s) and/or the second antenna branch comprises second bend(s).

Optionally, the hearing aid further includes a battery, wherein either the first antenna branch or the second antenna branch surrounds the battery.

Optionally, the differential transmission line is a balanced transmission line.

Optionally, the first antenna branch, the second branch, or the third antenna branch comprises a curved section.

Optionally, each of two or more of the first antenna branch, the second branch, and the third antenna branch, comprises a curved section.

Optionally, the third antenna branch extends between the first distal end of the first antenna branch and the second distal end of the second antenna branch.

Optionally, the electrical length of the first antenna branch and the electrical length of the second antenna branch are the same.

Optionally, the electrical length of the first antenna branch refers to an amount of phase-shift that a signal undergoes when it travels along the first antenna branch.

Optionally, the hearing aid comprises an in-the-canal (ITC) hearing aid.

Optionally, the hearing aid comprises an in-the-ear (ITE) hearing aid.

Further advantages and features of embodiments will become apparent when reading the following detailed description in conjunction with the drawings.

DETAILED DESCRIPTION

Figure 1:
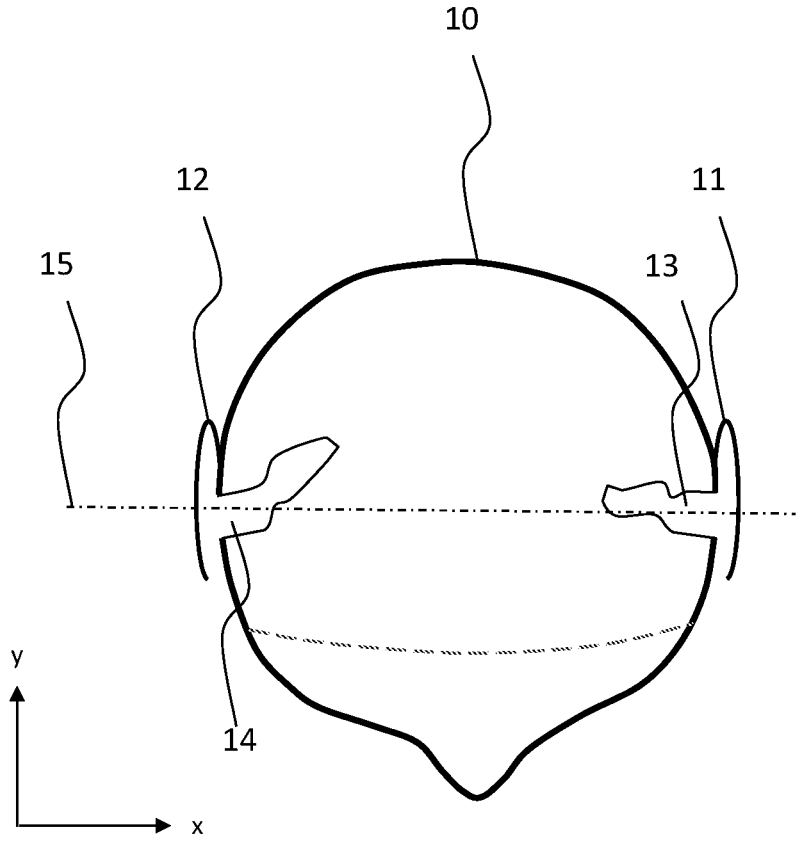
FIG. 1 is a head model of a user together with an ordinary two-dimensional coordinate system with an x, y axis for defining the geometrical anatomy of the head of the user.

Various embodiments are described hereinafter with reference to the figures. It should be noted that elements of similar structures or functions are represented by like reference numerals throughout the figures. It should also be noted that the figures are only intended to facilitate the description of the embodiments. They are not intended as an exhaustive description of the claimed invention or as a limitation on the scope of the claimed invention. In addition, an illustrated embodiment needs not have all the aspects or advantages shown. An aspect or an advantage described in conjunction with a particular embodiment is not necessarily limited to that embodiment and can be practiced in any other embodiments even if not so illustrated, or if not so explicitly described.

At least a first section of the first antenna branch may be parallel to at least a first section of the second antenna branch.

The third antenna branch may be perpendicular to at least one of the first and the second antenna branches.

The first distal end may be located opposite with respect to the second distal end.

The hearing aid may comprise a face plate. At least a section of the first antenna branch and/or at least a section of the second antenna branch may be positioned adjacent the face plate. The third antenna branch may be perpendicular to a plane of the face plate, when the hearing aid is worn according to the use.

The first antenna branch may comprise one or more bends and/or the second antenna branch may comprise one or more bends.

The hearing aid may comprise a battery, wherein only one of the first and the second antenna branches surrounds the battery, when the battery is positioned according to the use.

The differential transmission line may be a balanced transmission line.

At least one of the first, second and third antenna branches, such as two or all of the first, second and third antenna branches, may comprise a curved section, when the antenna is positioned according to the use.

The embodiments will now be described more fully hereinafter with reference to the accompanying drawings, in which exemplary embodiments are shown. The claimed invention may, however, be embodied in different forms and should not be construed as limited to the embodiments set forth herein.

FIG. 1 is a head model of a user seen from above together with the ordinary, two-dimensional coordinate system. When designing antennas for wireless communication proximate the human body, the human head can be approximated by a rounded enclosure with sensory organs, such as the nose, ears, mouth and eyes attached thereto. Such a rounded enclosure 10 is illustrated in FIG. 1. In FIG. 1, the head model 10 is shown from above together with an ordinary two-dimensional coordinate system with an x, and y axis for defining orientations with relation to the head and for defining the geometrical anatomy of the head of the user. The user modelled with the head of FIG. 1 is standing on the ground (not shown in the figure), and the ground plane is parallel to the xy-plane. The head model 10 comprises a left ear 11 and a right ear 12. The left ear 11 has a left ear canal 13. The right ear 12 has a right ear canal 14. An in-the-ear hearing aid is to be placed with at least a part going into the ear canal 13, 14. The axis 15 going from an opening of the right ear canal 14 to an opening of the left ear canal 13 is parallel to the x-axis of FIG. 1. The axis 15 is an ear-to-ear axis or an ear axis. The axis 15 is thus orthogonal to the surface of the head at the points where it leaves the surface of the head. The ear-to-ear axis as well as the surface of the head will in the following be used as reference when describing specific configurations of the present disclosure.

Every point of the surface of the head has a normal and tangential vector. The normal vector is orthogonal to the surface of the head while the tangential vector is parallel to the surface of the head. An element extending along the surface of the head is said to be parallel to the surface of the head, likewise a plane extending along the surface of the head is said to be parallel to the surface of the head, while an object or a plane extending from a point on the surface of the head and radially outward from the head into the surrounding space is said to be orthogonal or perpendicular to the surface of the head.

Since the auricle (pinna, outer ear) is primarily located in the plane parallel to the surface of the head on most test persons, it is often described that the ear-to-ear axis also functions as the normal to the ear. Even though there will be variations from person to person as to how the plane of the auricle is oriented, it is in this disclosure envisaged that the plane of the auricle is parallel to the surface of the head.

The hearing aid may be an in-the-ear type hearing aid. The in-the-ear type hearing aid has an elongated housing shaped to fit in the ear canal. A partition axis in this type of hearing aid is parallel to the ear axis 15, whereas the face plate of the in-the-ear type hearing aid typically is in a plane orthogonal to the ear axis 15. In other words, a partition axis in this type of hearing aid is in a plane orthogonal to a surface of a head of a user, whereas the face plate of the in-the-ear type hearing aid typically is parallel to a surface of a head of a user. An in-the-ear type hearing aid will be more thoroughly discussed in connection with FIGS. 3 and 4.

Figure 2:
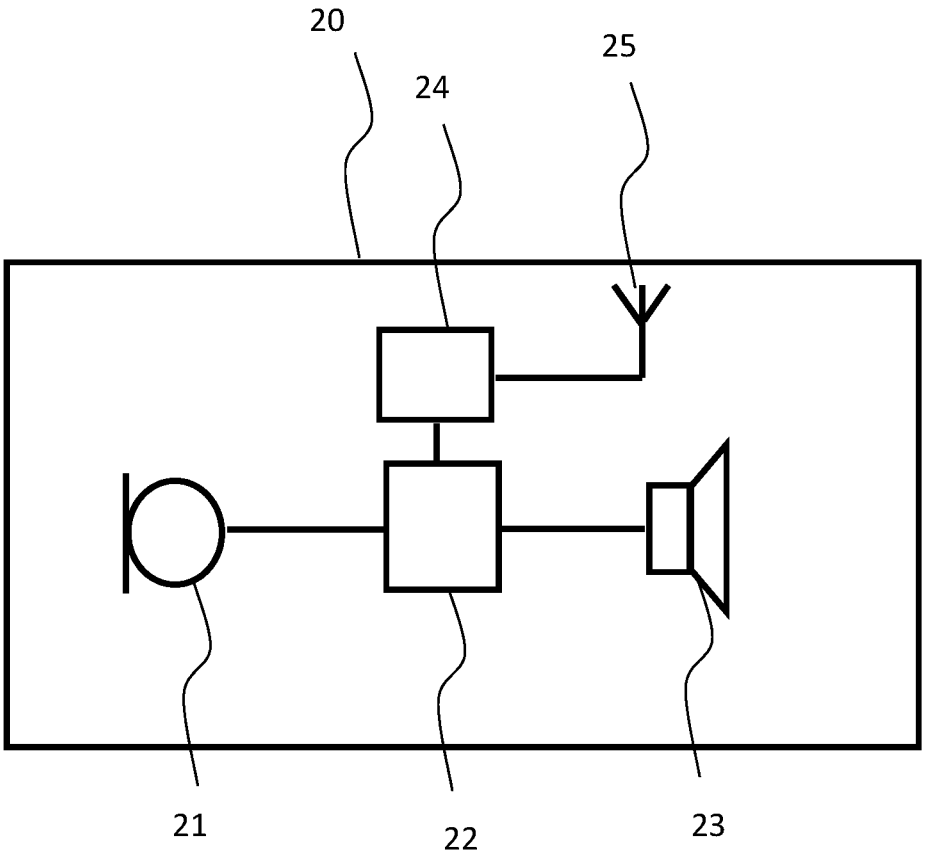
FIG. 2 shows a block-diagram of a typical hearing aid.

FIG. 2 shows a block-diagram of a typical hearing aid. In FIG. 2, the hearing aid 20 comprises a microphone 21 for receiving incoming sound and converting it into an audio signal, i.e. a first audio signal. The first audio signal is provided to a signal processor 22 for processing the first audio signal into a second audio signal compensating for the hearing loss of a user of the hearing aid. A receiver may be connected to an output of the signal processor 22 for converting the second audio signal into an output sound signal, e.g. a signal modified to compensate for user's hearing impairment, and provides the output sound to a speaker 23. Thus, the hearing instrument signal processor 22 may comprise elements such as amplifiers, compressors and noise reduction systems etc. The hearing aid may further have a feedback loop for optimizing the output signal. The hearing aid comprises a wireless communication unit 24 (e.g. a transceiver) for wireless communication connected with an antenna 25 for emission and reception of an electromagnetic field. The wireless communication unit 24 may connect to the hearing aid signal processor 22 and to the antenna 25, for communicating with e.g. external devices, or with another hearing aid, located at another ear, in a binaural hearing aid system. The components 21, 22, 23, 24, 25 are placed in a housing of the hearing aid (shown in FIG. 3).

The wireless communications unit may be configured for wireless data communication, and in this respect connected with the antenna for emission and/or reception of an electromagnetic field. The wireless communications unit may comprise a transmitter, a receiver, a transmitter-receiver pair, such as a transceiver, a radio unit, etc. The wireless communications unit may be configured for communication using any protocol as known for a person skilled in the art, including Bluetooth, WLAN, standards, manufacture specific protocols, such as tailored proximity antenna protocols, such as proprietary protocols, such as low-power wireless communication protocols, etc.

The specific wavelength (λ), and thus the frequency of the emitted electromagnetic field, is of importance when considering communication involving an obstacle. In the present disclosure, the obstacle is user's head. The hearing aid comprising an antenna is typically located in the ear canal. If the wavelength is too long, for frequencies of 1 GHz and below, greater parts of the head will be located in the near field region. This results in a different diffraction making it more difficult for the electromagnetic field to travel around the head. If on the other hand the wavelength (λ) is too short, the head will appear as being too large an obstacle which also makes it difficult for electromagnetic waves to travel around the head. An optimum between long and short wavelengths is therefore preferred. In general, the ear-to-ear communication is to take place in the dedicated frequency band for wireless communication for industrial and scientific applications. This frequency band is centered around 2.4 GHz. The corresponding wavelength (λ) is then 12.49 cm/4.9 inches.

Figure 3:
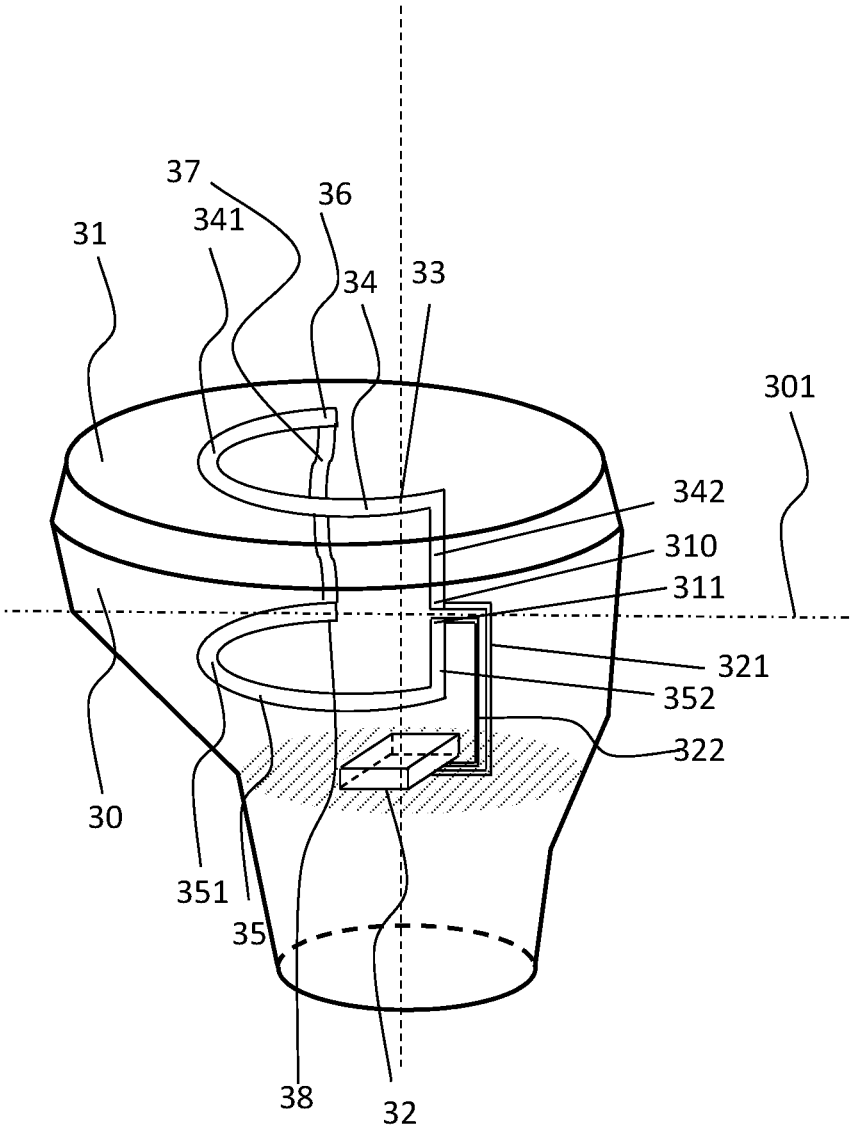
FIG. 3 shows an in-the-ear hearing aid having an antenna according to one embodiment of the present disclosure.

FIG. 3 shows an exemplary in-the-ear hearing aid 30 having an antenna 33 according to one embodiment of the present disclosure. The hearing aid 30 comprises an assembly. The assembly comprises a wireless communication unit 32 for wireless communication interconnected with an antenna 33 for emission and/or reception of an electromagnetic field. The wireless communication unit 32 may connect to a hearing aid signal processor. The wireless communication unit 32 is connected to the antenna 33, for communicating with e.g. external devices, or with another hearing aid, located at another ear, in a binaural hearing aid configuration. The connection may be realized by means of a differential transmission line 321, 322. In a further, related embodiment, said differential transmission line is a balanced transmission line. In this way, the impedance of each transmission line to ground and to all other conductors is the same.

The antenna 33 of the hearing aid 30 comprises a first feed point 310 connected to the wireless communication unit 32 and a second feed point 311. The antenna 33 of the hearing aid 30 comprises a first antenna branch 34 connected to the first feed point 310 and a second antenna branch 35 connected to the second feed point 311. The first antenna branch 34 comprises a first distal end 36. The second antenna branch 35 comprises a second distal end 38. In the embodiment shown in FIG. 3, at least a section of the first antenna branch 33 is parallel to the second antenna branch 34. As shown in FIG. 3, the first and the second antenna branches comprise a curved section, when the antenna is positioned according to the use.

The antenna 33 has a partition plane 301, such as a plane of intersection, extending between the first antenna branch 34 and the second antenna branch 35. The partition plane 301 may be a symmetry plane of the antenna 33.

The first distal end 36 is located across from the second distal end 38 with respect to the partition plane 301. In other words, the first distal end 36 is located opposite with respect to the second distal end 38.

A third antenna branch 37 extends between the first distal end 36 and the second distal end 38 so as to connect the first and the second branch 34, 35. Preferably, ratio of the electrical length of the third antenna branch 37 to the first or the second antenna branch is at least 0.1.

Hereby, an antenna solution lacking free ends is achieved. Numerous advantages are conferred by this design. More specifically, the inventive antenna structure is less prone to detuning. Further, the finished antenna is smaller than its counterpart having open ends. Finally, a more robust technical solution is obtained.

As easily inferred from FIG. 3, the third antenna branch 37 is perpendicular to a plane of the face plate 31, when the hearing aid is worn according to the use. Further, the third antenna branch 37 is substantially perpendicular to at least one of the first and the second antenna branches 33, 34.

The hearing aid 30 further comprises a face plate 31. The hearing aid 30 is to be inserted in the ear of a user with the deep end in the ear canal. The surface of the inserted hearing aid that faces away from the ear drum and which is often directly visible from the outside is called the front plate or the face plate. Of all the surfaces of the hearing aid, the face plate is the one that is least concealed by the ear. The face plate has an opening such that sound can reach a microphone arranged in the device. At least a section of the first antenna branch 34 and/or at least a part of the second antenna branch 35 is/are positioned adjacent the face plate 31.

A part of the face plate extends in a front plane, and the first plane and/or the second plane may be parallel with the front plane. The front plane may be orthogonal (or normal +/−25 degrees) to an ear-to-ear axis. The front plane may be parallel or substantially parallel to a surface of a head of a user, when the hearing aid is worn in its operational position on the head of the user. The first plane and/or the second plane may be parallel to a section of the face plate 31, or to a surface of a head of a user, when the hearing aid is worn in its operational position on the head of the user. A section of the first antenna branch 34 and/or a section of the second antenna branch 35 may be parallel with the front plane to a part of the face plate 31, or to a surface of a head of a user, when the hearing aid is worn in its operational position on the head of the user. Another section of the first antenna branch 34 is orthogonal (or normal +/−25 degrees) to the front plane. Additionally or alternatively, another section of the second antenna branch is orthogonal (or normal +/−25 degrees) to the front plane.

In one or more embodiments, a shortest physical distance between the curved section 341, 342 and the corresponding curved section 351, 352 is between 1.5 mm and 6.5 mm. A shortest physical distance between the first distal end 36 and the second distal end 38 may also be between 1.5 mm and 6.5 mm.

In one or more embodiments, the second feed point may be connected to a ground plane.

Although not shown, it is to be understood that any of the first and the second antenna branches comprises one or more bends.

Figure 4:
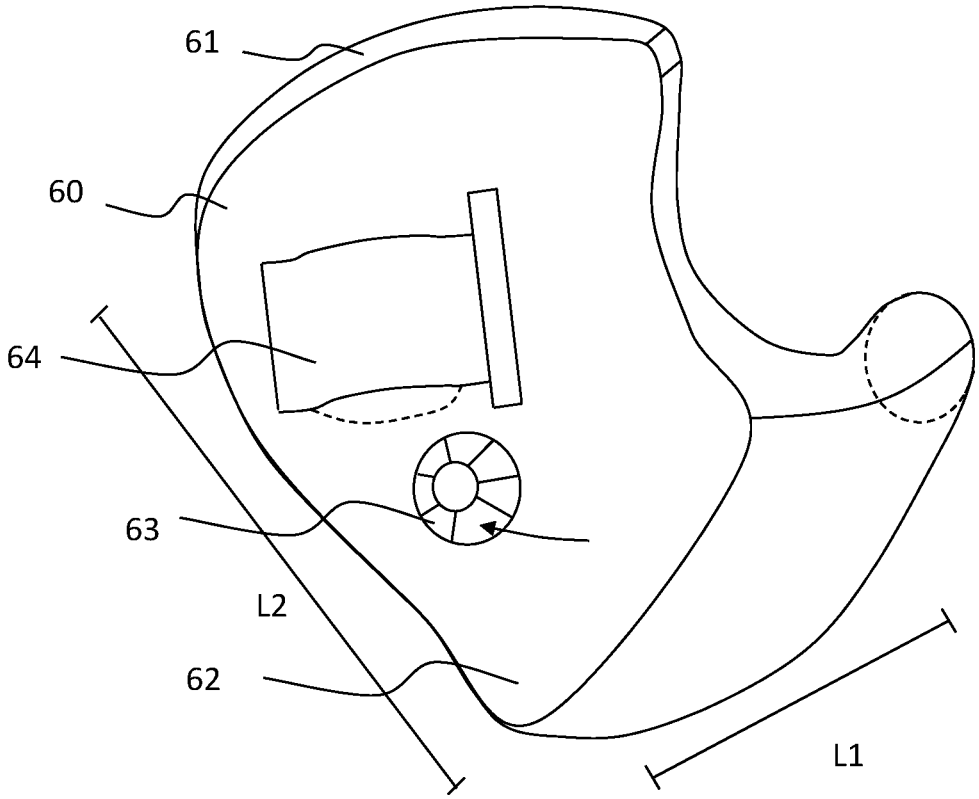
FIG. 4 shows schematically an exemplary in-the-ear hearing aid according to one embodiment of the present disclosure.

FIG. 4 shows an exemplary in-the-ear hearing aid 60 according to one embodiment. The shell 61 of the hearing aid 60 is customized to the ear of the user. The hearing aid 60 comprises a front plate 62. The front plate 62 has a button 63 for turning the volume up and down and a battery door 64 that can be opened for removing and/or inserting a battery. The deep end of the hearing aid goes a little bit into the ear canal. The depth of the hearing aid 60 is measured from the front plate to the deepest end, such as along length L1. The width is measured as the width of the front plate, such as along length L2. For large ITE-devices, the width is often greater than the depth. Thereby, the ITE-axis may not correspond to the longitudinal axis of the hearing aid.

Figure 5:
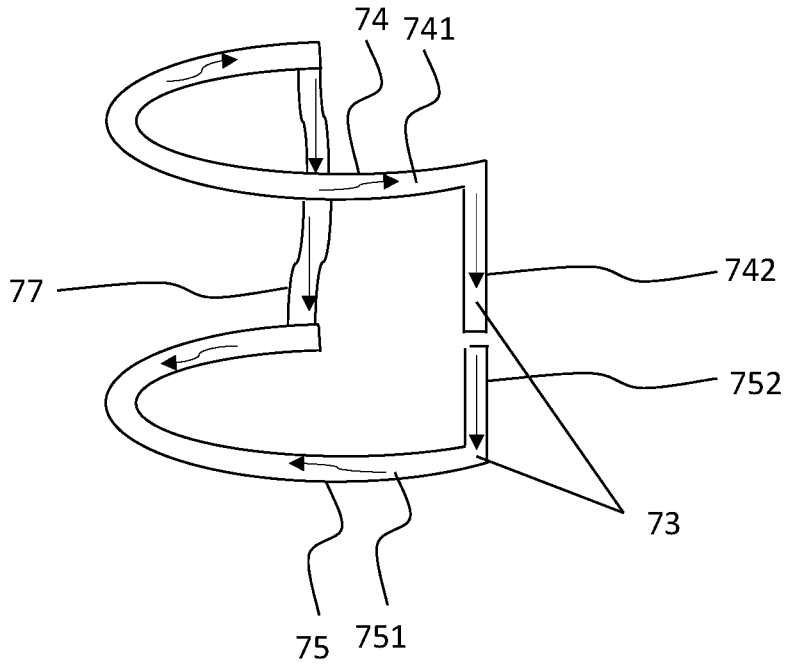
FIG. 5 shows schematically a direction of the current flowing in an exemplary antenna of a hearing aid according to one embodiment of the present disclosure.

FIG. 5 shows schematically a direction of the currents flowing in an exemplary antenna 73 of a hearing aid. The antenna 73 comprises a first antenna branch 74, a second antenna branch 75 and a third antenna branch 77. The first antenna branch 74 comprises a first, rectilinear section 741 and a second, curved section 742. The second antenna branch 75 also comprises a first, rectilinear section 751 and a second, curved section 752. The second antenna branch 75 is a mirror of the first antenna branch 74.

Currents flowing in the respective curved section 742, 752 have opposite directions. The antenna 73 is fed such that the current in the first antenna branch 74 will be out of phase with the current in the second antenna branch 75, preferably exactly 180 degrees out of phase. With an appropriate geometry of the curved sections 741, 751, the sum of the currents flowing in these sections will be substantially zero. If the sections 741, 751 are relatively close and the current in the section 741 flowing in opposite direction to the current flowing in the section 751 has an amplitude equivalent to the amplitude of the current in the section 751, an electromagnetic field radiated by the section 741 may be thereby substantially cancelled by an electromagnetic field radiated by the section 751.

By virtue of the claimed antenna configuration, the current distribution in the third antenna branch 77 reaches a maximum. In consequence, the dipole moment radiated by the third antenna branch 77 is maximized. Here and as discussed in connection with FIG. 3, the third antenna branch 77 is normally oriented substantially perpendicular to the face plate (not shown in FIG. 5) and to the lateral surface of the head of the user, when the hearing aid is worn in its operational position. In consequence, the maximized current flowing in the third antenna branch 77 contributes to a strong electromagnetic field that travels around the head of the user, passing also by the top of the head. In other words, wireless communication between the two hearing aids worn in the ear is enabled. A robust and powerful antenna solution for the hearing aid is hereby provided that in addition experiences low losses.

In a further embodiment (not shown), only one of the first and the second antenna branches surrounds the battery, when the battery is positioned according to the use. Advantageously, the two branches then cannot be short-circuited, as they are not in proximity to the same piece of metal, here battery. At high frequencies, the capacitive coupling between parallel plates, i.e. the battery surface and the antenna trace, becomes an increasingly advantageous connection for the high frequency signals, to the point where they might as well have been connected directly. Therefore, it is preferred to avoid designing all antenna traces at a close distance to the same conductive object.

In one or more embodiments, the antenna and/or the wireless communication unit are comprised in a substrate. The substrate allows bending the antenna to fit inside the hearing aid. A first segment of the first branch of the antenna may be placed on a first side of the substrate while another segment of the first branch of the antenna may be placed on a second side of the substrate. Additionally or alternatively, a second segment of the second branch of the antenna may be placed on a first side of a substrate while another segment of the second branch of the antenna may be placed on a second side of the same substrate.

The use of the terms "first", "second", and the like does not imply any particular order, but they are included to identify individual elements. Moreover, the use of the terms first, second, etc. does not denote any order or importance, but rather the terms first, second, etc. are used to distinguish one element from another. Note that the words first and second are used here and elsewhere for labelling purposes only and are not intended to denote any specific spatial or temporal ordering. Furthermore, the labelling of a first element does not imply the presence of a second element.

Also, as used in the specification, the term "substantially" refers to a degree of variation that is ±10%. For example, two items that are substantially perpendicular refer to the an item forming 90°±9° with respect to the another item. Similarly, two items that are substantially parallel refers to an item forming 180° (or 0°)°±18° with respect to another item.

Although particular embodiments have been shown and described, it will be understood that it is not intended to limit the claimed inventions to the preferred embodiments, and it will be obvious to those skilled in the art that various changes and modifications may be made without departing from the spirit and scope of the claimed inventions. The specification and drawings are, accordingly, to be regarded in an illustrative rather than restrictive sense. The claimed inventions are intended to cover alternatives, modifications, and equivalents.

The invention claimed is:

1. A hearing aid having an assembly, the assembly comprising:

a microphone configured to receive sound and to provide a first audio signal based on the received sound;

a signal processor configured to provide a second audio signal based on the first audio signal for compensating a hearing loss of a user of the hearing aid;

an antenna configured for electromagnetic field emission and/or electromagnetic field reception at a wavelength λ; and a wireless communication unit configured for wireless communication, the wireless communication connected with the antenna;

wherein the antenna comprises:

a differential transmission line configured to carry a first antenna feed signal and a second antenna feed signal to a first antenna feed point and a second antenna feed point, wherein the first antenna feed signal and the second antenna feed signal are out of phase, a first antenna branch extending from the first antenna feed point and having a first distal end, wherein an electrical length of the first antenna branch is anywhere from 3λ/8 to 5λ/8, a second antenna branch extending from the second antenna feed point and having a second distal end, wherein an electrical length of the second antenna branch is anywhere from 3λ/8 to 5λ/8, and a third antenna branch connecting the first antenna and the second antenna branch; and wherein the hearing aid is an in-the-canal (ITC) hearing aid or an in-the-ear (ITE) hearing aid, and wherein the hearing aid comprises a housing configured to accommodate the signal processor and the antenna, the housing being configured for placement in an ear.

2. The hearing aid according to claim 1, wherein at least a first section of the first antenna branch is parallel to at least a first section of the second antenna branch.

3. The hearing aid according to claim 1, wherein the third antenna branch is perpendicular to at least one of the first and the second antenna branches.

4. The hearing aid according to claim 1, wherein the first distal end is located opposite with respect to the second distal end.

5. The hearing aid according to claim 1, further comprising a face plate, wherein at least a section of the first antenna branch and/or at least a section of the second antenna branch is positioned adjacent the face plate.

6. The hearing aid according to claim 5, wherein the third antenna branch is perpendicular to a plane of the face plate.

7. The hearing aid according to claim 1, wherein the first antenna branch comprises first bend(s) and/or the second antenna branch comprises second bend(s).

8. The hearing aid according to claim 1, further comprising a battery, wherein either the first antenna branch or the second antenna branch surrounds the battery.

9. The hearing aid according to claim 1, wherein the first antenna branch, the second branch, or the third antenna branch comprises a curved section.

10. The hearing aid according to claim 1, wherein each of two or more of the first antenna branch, the second branch, and the third antenna branch, comprises a curved section.

11. The hearing aid according to claim 1, wherein the electrical length of the first antenna branch and the electrical length of the second antenna branch are the same.

12. The hearing aid according to claim 1, wherein the electrical length of the first antenna branch refers to an amount of phase-shift that a signal undergoes when it travels along the first antenna branch.

13. A hearing aid comprising:

a microphone configured to receive sound and to provide a first audio signal based on the received sound;

a signal processor configured to provide a second audio signal based on the first audio signal for compensating a hearing loss of a user of the hearing aid;

an antenna configured for electromagnetic field emission and/or electromagnetic field reception; and a wireless communication unit configured for wireless communication, the wireless communication connected with the antenna;

wherein the antenna comprises:

a first antenna branch extending from a first antenna feed point, a second antenna branch extending from a second antenna feed point, and a third antenna branch connecting the first antenna branch and the second antenna branch;

wherein the hearing aid is an in-the-canal (ITC) hearing aid or an in-the-ear (ITE) hearing aid, wherein the hearing aid comprises a housing configured to accommodate the signal processor and the antenna, the housing configured for placement in an ear, and wherein the housing comprises a faceplate, at least a part of the faceplate extending in a plane; and wherein the third antenna branch is perpendicular to the plane of the part of the faceplate of the housing that is configured for placement in the ear.

14. A hearing aid comprising:

a microphone configured to receive sound and to provide a first audio signal based on the received sound;

a signal processor configured to provide a second audio signal based on the first audio signal for compensating a hearing loss of a user of the hearing aid;

an antenna configured for electromagnetic field emission and/or electromagnetic field reception; and a wireless communication unit configured for wireless communication, the wireless communication connected with the antenna;

wherein the antenna comprises:

a first antenna branch extending from a first antenna feed point, a second antenna branch extending from a second antenna feed point, and a third antenna branch connecting the first antenna branch and the second antenna branch;

wherein the hearing aid is an in-the-canal (ITC) hearing aid or an in-the-ear (ITE) hearing aid, and wherein the hearing aid comprises a housing configured to accommodate the signal processor and the antenna, the housing being configured for placement in an ear, and wherein the housing comprises a faceplate;

wherein the faceplate is located closer to the first antenna branch than to the second antenna branch, and wherein at least a part of the faceplate extends in a plane; and wherein at least a section of the first antenna branch is parallel to the plane of the part of the faceplate of the housing that is configured for placement in the ear.

15. The hearing aid according to claim 14, further comprising a differential transmission line, wherein the differential transmission line is a balanced transmission line.

16. The hearing aid according to claim 14, wherein the third antenna branch extends between a first end of the first antenna branch and a second end of the second antenna branch.

17. The hearing aid according to claim 14, wherein at least a first section of the first antenna branch is parallel to at least a first section of the second antenna branch.

18. The hearing aid according to claim 14, wherein the third antenna branch is perpendicular to at least one of the first and the second antenna branches.

19. The hearing aid according to claim 14, wherein the first antenna branch comprises first bend(s) and/or the second antenna branch comprises second bend(s).

20. The hearing aid according to claim 14, further comprising a battery, wherein either the first antenna branch or the second antenna branch surrounds the battery.

21. The hearing aid according to claim 14, wherein the first antenna branch, the second branch, or the third antenna branch comprises a curved section.

22. The hearing aid according to claim 14, wherein each of two or more of the first antenna branch, the second branch, and the third antenna branch, comprises a curved section.

23. The hearing aid according to claim 14, wherein the hearing aid comprises a surface intersecting an ear-to-ear axis of a user when the hearing aid is in an operative position with respect to the user.

24. A hearing aid comprising:

a microphone configured to receive sound and to provide a first audio signal based on the received sound;

a signal processor configured to provide a second audio signal based on the first audio signal for compensating a hearing loss of a user of the hearing aid;

an antenna configured for electromagnetic field emission and/or electromagnetic field reception;

a wireless communication unit configured for wireless communication, the wireless communication connected with the antenna; and wherein the antenna comprises:

a first antenna branch extending from a first antenna feed point, a second antenna branch extending from a second antenna feed point, and a third antenna branch connecting the first antenna branch and the second antenna branch;

wherein the hearing aid is an in-the-ear (ITE) hearing aid or an in-the-canal (ITC) hearing aid, wherein the hearing aid comprises a housing configured to accommodate the signal processor and the antenna, the housing being configured for placement in an ear, and wherein the housing comprises a faceplate;

wherein the faceplate is located closer to the first antenna branch than to the second antenna branch, and wherein at least a part of the faceplate extends in a plane; and wherein a part of the antenna forms an angle that is anywhere from 65 degrees to 115 degrees with respect to the plane of the part of the faceplate of the housing that is configured for placement in the ear.

25. The hearing aid according to claim 24, wherein at least a section of the first antenna branch and/or at least a section of the second antenna branch is parallel to the plane of the part of the faceplate.

26. The hearing aid according to claim 24, wherein at least a first section of the first antenna branch is parallel to at least a first section of the second antenna branch.

27. The hearing aid according to claim 24, wherein the third antenna branch is perpendicular to at least one of the first and the second antenna branches.

28. The hearing aid according to claim 24, wherein the first antenna branch comprises first bend(s) and/or the second antenna branch comprises second bend(s).

29. The hearing aid according to claim 24, further comprising a battery, wherein either the first antenna branch or the second antenna branch surrounds the battery.

30. The hearing aid according to claim 24, further comprising a differential transmission line, wherein the differential transmission line is a balanced transmission line.

31. The hearing aid according to claim 24, wherein the first antenna branch, the second branch, or the third antenna branch comprises a curved section.

32. The hearing aid according to claim 24, wherein each of two or more of the first antenna branch, the second branch, and the third antenna branch, comprises a curved section.

33. The hearing aid according to claim 24, wherein the third antenna branch extends between a first end of the first antenna branch and a second distal end of the second antenna branch.

34. The hearing aid according to claim 24, wherein the hearing aid comprises a surface intersecting an ear-to-ear axis of a user when the hearing aid is in an operative position with respect to the user.

35. The hearing aid according to claim 1, 14, 24, or 13, wherein the hearing aid comprises a surface intersecting an ear-to-ear axis of a user when the hearing aid is in an operative position with respect to the user.

36. The hearing aid according to claim 35, wherein at least a first section of the first antenna branch is parallel to at least a first section of the second antenna branch.

37. The hearing aid according to claim 13, wherein the third antenna branch is perpendicular to at least one of the first and the second antenna branches.

38. The hearing aid according to claim 13, wherein the first antenna branch comprises first bend(s) and/or the second antenna branch comprises second bend(s).

39. The hearing aid according to claim 13, further comprising a battery, wherein either the first antenna branch or the second antenna branch surrounds the battery.

40. The hearing aid according to claim 13, further comprising a differential transmission line, wherein the differential transmission line is a balanced transmission line.

41. The hearing aid according to claim 13, wherein the first antenna branch, the second branch, or the third antenna branch comprises a curved section.

42. The hearing aid according to claim 13, wherein each of two or more of the first antenna branch, the second branch, and the third antenna branch, comprises a curved section.

43. The hearing aid according to claim 13, wherein the third antenna branch extends between a first end of the first antenna branch and a second end of the second antenna branch.

44. The hearing aid according to claim 13, wherein the hearing aid comprises a surface intersecting an ear-to-ear axis of a user when the hearing aid is in an operative position with respect to the user.

* * * * *